United States Patent [19]

Adamek-Hetzel

[11] Patent Number: 4,870,955

[45] Date of Patent: Oct. 3, 1989

[54] MASSAGE BELT INCLUDING ROTATABLE BLOCKS

[76] Inventor: Karl Adamek-Hetzel, Wolbecker Strasse 84, Münster, Fed. Rep. of Germany, 4400

[21] Appl. No.: 287,549

[22] Filed: Dec. 19, 1988

Related U.S. Application Data

[63] Continuation of Ser. No. 196,858, May 20, 1988, abandoned, which is a continuation of Ser. No. 21,153, Mar. 3, 1987, abandoned.

[51] Int. Cl.[4] ..... A61H 11/00

[52] U.S. Cl. ..... 128/58; 128/57

[58] Field of Search ..... 128/58, 57, 63, 44, 128/67, 62 R, 60, 56

[56] References Cited

U.S. PATENT DOCUMENTS 662,083 11/1900 McFadden ..... 128/57
681,331 8/1901 Milkman ..... 128/58

FOREIGN PATENT DOCUMENTS 0177953 4/1986 European Pat. Off. ..... 128/58
663351 7/1938 Fed. Rep. of Germany ..... 128/57
1949890 4/1971 Fed. Rep. of Germany ..... 128/57
1197963 12/1959 France .

*Primary Examiner*—Edgar S. Burr
*Assistant Examiner*—Huong Q. Pham
*Attorney, Agent, or Firm*—Felfe & Lynch

[57] ABSTRACT

A massage belt is disclosed comprising a peripheral, closed profile member formed of a resilient material deining a rim. Wire rails or rods extend transversely between the longitudinal portions of the profile member and at least three rectangular blocks of wood rotatably mounted on each wire rail. Each block of wood includes a bore for passing the wire rail therethrough. This bore defines an angle $\alpha$ of between 2° and 25° relative to one of the three mutually perpendicular axes of the block.

8 Claims, 1 Drawing Sheet

MASSAGE BELT INCLUDING ROTATABLE BLOCKS

This application is a continuation, of application Ser. No. 196,858, filed May 20, 1988 which is a continuation of application Ser. No. 021,153 filed Mar. 3, 1987 (now abandoned).

BACKGROUND OF THE INVENTION

The present invention relates to a massage belt comprising a peripheral, closed profile member formed of a resilient material and defining a rim, wire rails or rods extending transversely between the longitudinal portions of the profile member, and at least one elongated block of wood rotatably mounted on each wire rail.

For the self-massage of muscular stiffness, especially in the region of the shoulder and in the doral region, hand-held massage instruments are known which have approximately the shape of a belt. Such a belt is moved to and fro across the respective body portions with a higher or lower contact pressure, thereby exerting a massaging effect. This effect is caused either by a certain surface roughness of the belt or by small rotatable blocks attached to the belt. In a conventional massage belt of the last-mentioned type, the rim is formed of a peripheral, resilient closed profile member. Extending transversely of the rim of the profile member, from one side to the other, are wire rails (or wire rods) each of which have mounted thereon a pair of elongated blocks of wood.

Although a massage belt of this type in fact provides a massaging effect, this belt nevertheless suffers from a number of drawbacks. As only one or two blocks of wood are mounted on each of the transversely extending wire rails, a relatively wide area of the massaged muscular surface is covered by a single block. Owing to the large bearing or contact surface of a single block, the force exerted on the muscle, and thus the massaging effect, is relatively low. Another drawback results from the fact that the blocks of wood of the conventional massage belt are all bored through in the same direction to receive the respective wire rail. Consequently, with the movement of the belt across the body, an almost uniform force without any significant variations is exerted on the muscle. However, essential to a good effect of a massage is the clear alternation of application and release of small-area forces on the muscle.

SUMMARY OF THE INVENTION

It is therefore the object of the invention to provide a massage belt which avoids the above-mentioned drawbacks and, in particular, exerts high forces on the muscle, while at the same time providing for an alternation of application and release of such forces, which belt may be adapted to various uses and needs of the user with respect to the intensity of the massage.

This object is solved by a massage belt comprising a peripheral, closed profile member defining the rim and formed of a resilient (flexible) material, wherein wire rails or rods extend transversely between the longitudinal portions of the profile member, with at least one elongated block of wood of substantially square cross-section being rotatably slipped onto each wire rail, wherein each wire rail has slipped thereon three blocks of wood and each block of wood has a bore for the wire rail which extends at an angle to a center axis of the block.

With this structure, it is achieved that, with an approximately unvaried overall width of the belt relative to the conventional belt, the bearing or contact surface of the blocks of wood on the body or muscular surface is smaller, whereby the force exerted on the muscle becomes higher.

In a preferred embodiment of the massage belt according to the invention, the bore formed in each block of wood, for passing the wire rail therethrough, defines an angle of between 2° and 25° relative to the associated center axis of the block so that, as a consequence, the openings of the bores are shifted toward the corners of the end faces of each block. This diagonal and eccentric extension of the bores provides the effect that the block of wood, during the rotation thereof, does not only contact the muscle alternatingly with a flat side (face) or an edge only, but additionally performs a tumbling or spinning motion. In this way, a significantly higher difference between force exertion and force release is obtained, because the stroke of a block—i.e., the variation of the spacing of the part of the block which respectively faces the muscle from the axis of rotation of the block—is substantially longer. In view of the fact that with this structure not only surfaces or relatively long edges of the block, but also corners of the block contact the muscle, the depth effect of the massage is improved. This is very essential to a relaxation of strained or stiff muscles since massage action effective only near the surface is insufficient to accomplish this end.

In order to provide for an adaptation to various uses and needs of the user, in further embodiments the massage belt according to the invention includes blocks having a bore angle which is between 6° and 20°, between 10° and 16°, or about 13° with respect to the center axis. By such a variation of the bore angle, the massage belt is sufficiently variable in its intensity of effectiveness and suitable for various uses and users. Because a reduction of the angle, to about zero in an extreme case, results in a reduction of the difference between force exertion and force release on the muscle, such a reduction results in a more gentle massage.

A further embodiment of the massage belt comprises blocks disposed in a row, i.e. on a wire rail, each block having an identical value of the bore angle. Preferably, here the bore angles of blocks mounted on adjacent wire rails are different from each other. By this structure, the alternation of force exertion and release is not only obtained with a time succession during the rolling movement of the blocks, but also spatially distributed or spread across the length of the belt. Furthermore, this embodiment of the massage belt permits the user, by correspondingly shifting the belt, to perform the massage with a greater number of small-angled or a greater number of large-angled blocks. Owing to the different bore angles, a variation of the massaging intensity can be obtained, as desired by the user.

In another advantageous embodiment, the massage belt includes blocks of different cross-sectional widths, viz. the outer surfaces and edges rotate with a longer or shorter spacing from the axis of rotation. Expediently, the blocks of wood slipped or mounted on a wire rail each have approximately the same width, but a different width from that of the blocks on adjacent wire rails. In this way, a succession of more intense and less intense action is obtained, which has a favorable effect on the muscle.

The length of the wire rails, and therefore the distance between facing portions of the rim profile member, is chosen so that the belt is easy to handle and the blocks of wood can smoothly rotate on the wire rails.

Accordingly, the invention provides a massage belt which in a variety of ways is adaptable to various uses and users, and which ensures a good massaging effect and primarily a good depth effect.

A preferred, exemplary embodiment of the massage belt according to the invention is described below in greater detail with reference to the drawing.

DESCRIPTION OF THE PREFERRED EMBODIMENT

Figure 1:
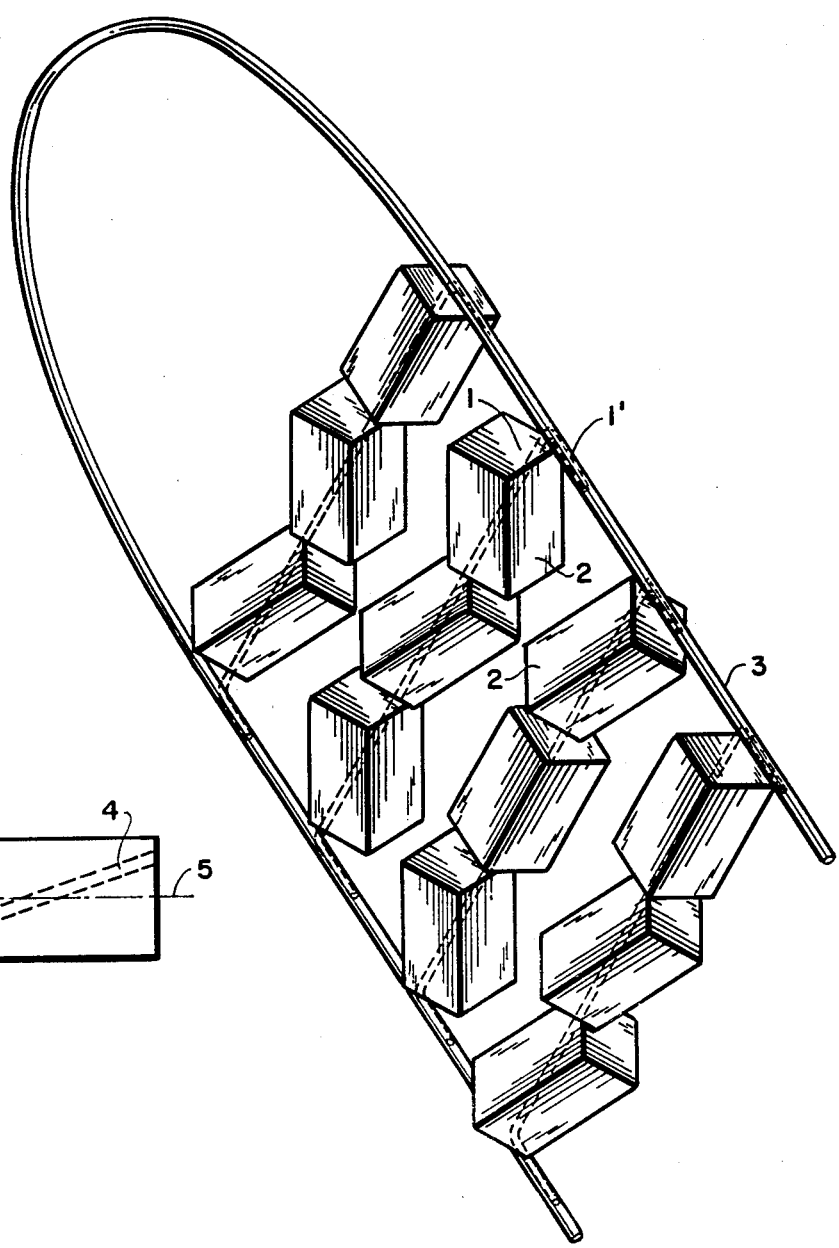
FIG. 1 is a perspective view of one end of a massage belt according to a preferred embodiment of the present invention. The opposite end of the massage belt is identical to that shown.
Figure 2:
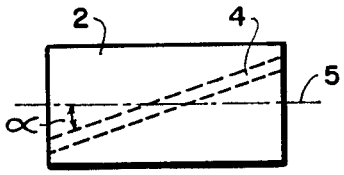
FIG. 2 is a sectional view of a block of wood in the massage belt of FIG. 1, with a bore hole formed therein.
Figure 3:
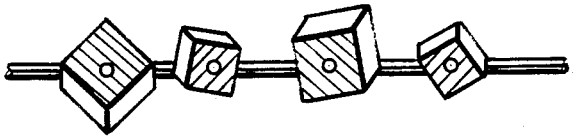
FIG. 3 is a cross-sectional side view taken along the longitudinal center line of the massage belt according to the invention showing each block as having a different diameter.

As shown in FIG. 1, in the illustrated preferred embodiment the massage belt comprises a peripheral hollow rim profile member 3 which is flexible and receives the ends 1' of wire rails or rods 1. Slipped onto the wire rails 1 are blocks of wood 2. Each block of wood has an approximately parallelepipedal (rectangular) shape with an approximately square cross-section normal to its longitudinal axis 5. As shown specifically in FIG. 2, each block of wood 2 is provided with a bore 4 which extends at an angle $\alpha$ relative to the longitudinal axis 5 of the respective block 2, and which permits the block 2 to smoothly rotate on the associated wire rail 1. In the embodiment shown in FIG. 3, the blocks of wood 2 on a wire rail or rod 1 have a different cross-sectional width than the blocks on an adjacent rail or rod.

There has thus been shown and described a novel massage belt which fulfills all the objects and advantages sought therefor. Many changes, modifications, variations and other uses and applications of the subject invention will, however, become apparent to those skilled in the art after considering this specification and the accompanying drawing which discloses the preferred embodiment thereof. All such changes, modifications, variations and other uses and applications which do not depart from the spirit and scope of the invention are deemed to be covered by the invention which is limited only by the claims which follow.

I claim:

1. A massage belt comprising a peripheral, closed profile member defining a rim and formed of resilient material, wherein wire rails or rods extend transversely from one side of the profile member to the other, with at least three elongated, rectangular blocks of wood of substantially square cross-section being rotatably slipped onto each wire rail, each block defining a central longitudinal axis and wherein each block includes a linear bore for passing the wire rail therethrough, said bore defining an angle of between 6° and 25° relative to said central axis of said block.

2. The massage belt according to claim 1, characterized in that said blocks of wood have end faces substantially transverse to said central axis which have four corners, and wherein the openings of the bores are offset toward the corners of the end faces.

3. The massage belt according to claim 2, characterized in that the angle $\alpha$ is between 6° and 20°.

4. The massage belt according to claim 3, characterized in that the angle $\alpha$ is between 10° and 16°.

5. The massage belt according to claim 4, characterized in that the angle $\alpha$ is about 13°.

6. The massage belt according to claim 1 or any one of claims 3 to 5, characterized in that one wire rail has slipped thereto into blocks with equal values of the angle $\alpha$.

7. The massage belt according to claim 1 or any one of claims 2 to 5, characterized in that the angle $\alpha$ of blocks slipped onto adjacently disposed wire rails is respectively different.

8. The massage belt according to claim 1 or any one of claims 2 to 7, characterized in that the rotatable blocks of wood each have a different cross-sectional width.

* * * * *

UNITED STATES PATENT AND TRADEMARK OFFICE

CERTIFICATE OF CORRECTION

PATENT NO. : 4,870,955

DATED : October 3, 1989

INVENTOR(S) : Karl Adamek-Hetzel

It is certified that error appears in the above-identified patent and that said Letters Patent is hereby corrected as shown below:

Column 1, line 18 for "doral" read -- dorsal --.

Column 3, line 31 for "wood has" read -- wood 2 has --.

Column 4, line 42 for "2 to 7" read -- 2 to 5 --.

Signed and Sealed this

Eleventh Day of August, 1992

*Attest:*

DOUGLAS B. COMER

*Attesting Officer*

*Acting Commissioner of Patents and Trademarks*